US012245643B2

(12) United States Patent
Austin

(10) Patent No.: US 12,245,643 B2
(45) Date of Patent: Mar. 11, 2025

(54) LOWER BODY GARMENT PROVIDING IMPROVED COMFORT

(71) Applicant: CXP Official Ltd, Birmingham (GB)

(72) Inventor: Thomas John Austin, Birmingham (GB)

(73) Assignee: CXP Official Ltd, Birmingham (GB)

( * ) Notice: Subject to any disclaimer, the term of this patent is extended or adjusted under 35 U.S.C. 154(b) by 9 days.

(21) Appl. No.: 18/027,405

(22) PCT Filed: Sep. 21, 2021

(86) PCT No.: PCT/EP2021/075903
§ 371 (c)(1),
(2) Date: Mar. 21, 2023

(87) PCT Pub. No.: WO2022/058607
PCT Pub. Date: Mar. 24, 2022

(65) Prior Publication Data

US 2023/0329355 A1 Oct. 19, 2023

(30) Foreign Application Priority Data

Sep. 21, 2020 (GB) ..... 2014859

(51) Int. Cl.
*A41B 9/00* (2006.01)
*A41B 9/14* (2006.01)

(52) U.S. Cl.
CPC ..... *A41B 9/001* (2013.01); *A41B 9/14* (2013.01); *A41D 2500/10* (2013.01)

(58) Field of Classification Search
CPC .. A41B 9/001; A41B 9/02; A41B 9/04; A41B 9/14
See application file for complete search history.

(56) References Cited

U.S. PATENT DOCUMENTS 1,937,899 A * 12/1933 Le Coney ..... A41B 9/04 2/406
2,060,467 A * 11/1936 Krein ..... A41F 9/02 2/237

(Continued)

FOREIGN PATENT DOCUMENTS

DE 202007006695 U1 10/2008
EP 1031292 A2 8/2000

(Continued)

OTHER PUBLICATIONS

"PCT International Search Report and the Written Opinion of the International Searching Authority" International Filing Date: Sep. 21, 2021, International Application No. PCT/EP2021/075903, Date of Mailing: Jan. 17, 2022, pp. 1-14.

(Continued)

*Primary Examiner* — Alissa L Hoey
(74) *Attorney, Agent, or Firm* — Cesari and McKenna, LLP

(57) ABSTRACT

A durable lower body garment is provided that is formed of a plurality of fabric panels and has an inner surface for facing towards the wearer and an outer surface for facing away from the wearer, the plurality of fabric panels defining a waist opening and a pair of leg openings. The garment comprises a front fabric panel and at least one further fabric panel, the front fabric panel and the at least one further fabric panel being joined along their lateral edges to define the waist opening including a waist edge. Each of the front fabric panel and the at least one further fabric panel extends from the waist edge to at least a crotch region of the garment, and each of the front fabric panel and the at least one further fabric panel is formed of an elastically stretchable fabric.

22 Claims, 2 Drawing Sheets

(56) References Cited

U.S. PATENT DOCUMENTS 2,109,280 A * 2/1938 Bach ..... A41F 9/02 2/237
2,323,451 A * 7/1943 Bullinger ..... A41C 1/00 128/891
2,435,945 A * 2/1948 Redmond ..... A41B 9/04 D2/712
2,505,504 A * 4/1950 Roodner ..... A41B 9/04 2/406
2,702,903 A * 3/1955 Gourdon ..... A41C 1/003 450/130
2,711,542 A * 6/1955 Rosenberg ..... A41B 9/04 2/407
2,722,012 A * 11/1955 Blatt ..... A41B 9/04 2/406
2,772,419 A * 12/1956 Silverstein ..... A41B 9/04 2/406
2,852,780 A * 9/1958 Gold ..... A41B 9/04 2/408
2,905,947 A * 9/1959 Rosenberg ..... A41B 9/04 2/406
3,109,300 A * 11/1963 Garrou ..... A41B 9/04 D2/712
3,142,300 A * 7/1964 Erteszek ..... A41B 9/04 450/100
3,235,883 A * 2/1966 Salamon ..... A41B 9/001 450/101
3,852,828 A * 12/1974 Silverstein ..... A41B 9/04 2/401
3,854,978 A * 12/1974 Campbell, Sr. ..... D06N 7/0092 2/221
3,930,090 A * 12/1975 Campbell, Sr. ..... A41F 9/00 428/196
4,400,832 A * 8/1983 Kinder ..... A41B 9/08 128/100.1
4,538,615 A * 9/1985 Pundyk ..... A41C 1/003 450/131
6,243,880 B1 * 6/2001 Lyden ..... A41B 9/02 2/400
6,446,268 B1 * 9/2002 Lazarian ..... A41F 9/00 427/256
6,546,564 B1 * 4/2003 Palmer ..... A41B 9/14 2/409
7,931,639 B2 * 4/2011 Suga ..... A61F 13/72 2/329
8,082,598 B2 * 12/2011 Simpson ..... A41B 9/14 2/400
8,092,273 B2 * 1/2012 Shinomiya ..... A41B 9/001 450/97
8,424,118 B2 * 4/2013 Maxey ..... D04B 1/18 2/403
8,555,419 B2 * 10/2013 Demarest ..... A41F 9/025 2/237
8,784,351 B2 * 7/2014 Dumpson ..... A41C 1/10 602/61
9,301,550 B2 * 4/2016 Sabin ..... A41D 1/06
9,538,792 B2 * 1/2017 Essery ..... A41B 9/02
9,901,124 B2 * 2/2018 James ..... A41B 11/14
10,631,580 B2 * 4/2020 Henry ..... A41D 31/12
11,375,756 B1 * 7/2022 White ..... A41B 17/00
11,510,442 B2 * 11/2022 Strobel ..... A41F 9/00
11,528,945 B2 * 12/2022 Aiello ..... A61F 13/8405
11,553,739 B2 * 1/2023 Henry ..... A41D 1/08
11,684,102 B2 * 6/2023 Lazic ..... A41D 27/20 2/69
11,839,241 B2 * 12/2023 Liu ..... A41B 9/14
11,926,937 B2 * 3/2024 Blythe ..... D04B 1/14
2009/0254017 A1 * 10/2009 Dumpson ..... A41C 1/10 602/76
2015/0107004 A1 * 4/2015 Ishiura ..... A41B 9/04 2/406
2015/0296893 A1 * 10/2015 Blibech ..... A41F 9/02 28/165
2017/0164660 A1 * 6/2017 Austin ..... A41B 9/14
2020/0178628 A1 * 6/2020 Merrill ..... A41F 9/02
2020/0375274 A1 * 12/2020 McNally ..... A41D 1/089
2020/0397064 A1 * 12/2020 Liu ..... B32B 7/08
2021/0015684 A1 * 1/2021 Nakabugo ..... A61F 13/49017
2021/0251303 A1 * 8/2021 Collins ..... A41B 17/00
2021/0274856 A1 * 9/2021 Blythe ..... A41B 9/14
2022/0240611 A1 * 8/2022 Campalans ..... A41C 3/0064
2022/0295907 A1 * 9/2022 Harris ..... A41B 9/08
2022/0408850 A1 * 12/2022 Laurin ..... A41D 13/0058
2023/0338206 A1 * 10/2023 Welch ..... A41D 31/102
2024/0023638 A1 * 1/2024 Merrill ..... A41B 9/14

FOREIGN PATENT DOCUMENTS

EP 1859761 A1 11/2007
GB 2545220 A 6/2017

OTHER PUBLICATIONS

"United Kingdom Search Report and Written Opinion," United Kingdom Application No. GB2014859.9, Date of Mailing: Mar. 18, 2021, pp. 1-5.

* cited by examiner

LOWER BODY GARMENT PROVIDING IMPROVED COMFORT

CROSS-REFERENCE TO RELATED APPLICATIONS

The present application is the National Stage of International Application No. PCT/EP2021/075903, filed on Sep. 21, 2021, which claims priority from Great Britain Patent Application No. 2014859.9 filed on Sep. 21, 2020, the disclosure of both of which should be understood to be incorporated into this specification.

FIELD OF THE INVENTION

This invention relates to a durable lower body garment.

In particular, this invention relates to a durable lower body garment, such as a pair of briefs, which is formed of a plurality of fabric panels and having an inner surface for facing towards the wearer and an outer surface for facing away from the wearer, the plurality of fabric panels defining a waist opening and a pair of leg openings.

BACKGROUND TO THE INVENTION

Many types of lower body garment, including undergarments, have an elastic waistband which extends around the wearer's waist. The purpose of such a waistband is to hold the garment in place on the wearer's body, while permitting the garment to be removed easily.

In some designs, an integrated elastic waistband is formed by elasticising some or all of a waist hem of the garment, which causes gathering of the fabric around the waist opening. It has been found that garments such as this can lead to discomfort among wearers owing to the gathering of the fabric.

In other designs, a separate elastic waistband is attached to the garment so as to extend continuously along its waist opening and define a waist edge. However, for wearers engaged in high intensity or endurance sports, a continuous elastic waistband of this type can put stress on the abdomen, which can also cause discomfort to the wearer. The same applies to wearers having abdominal conditions (for example, wearers suffering from Inflammatory Bowel Disease or Irritable Bowel Syndrome, or wearers recovering from abdominal operations, such as caesarean sections), in which case a continuous elastic waistband can exacerbate the wearer's abdominal condition.

To address some of these problems, it has been proposed to provide a lower body garment formed of a plurality of fabric panels and a separate, non-continuous elastic waistband having spaced-apart ends. A waist edge of the garment is then defined by the elastic waistband and by a front fabric panel, which panel extends from the waist edge to the crotch region. The ends of the non-continuous elastic waistband are joined to lateral edges of the front waist panel. Such a garment is disclosed in GB 2545220 A.

The above-described garment includes a front fabric panel which extends from the waist edge to cover a lower abdominal region of the wearer. This means that the force which is carried through the elastic waistband is distributed through the larger area of the front fabric panel, thereby reducing the stress in the front fabric panel. This reduces the stress on the wearer's abdomen, thereby avoiding or at least mitigating the above-described problems. Moreover, the front fabric panel extending below the waistband to cover the lower abdominal region also reduces the problem of gaps forming between the wearer and the waistband, since the front panel's larger area allows it to deform more easily than a strip of elastic and to follow the profile of the wearer's body. This means that the fit of the garment is improved, since the garment sits flush to the wearer's body.

It has been found that the removal of pressure on the abdominal region, and the improved conformity between the garment and the wearer's body, reduces localised stresses on the wearer's body, leading in turn to improved performance in sportswear and medical applications. The garment disclosed in GB 2545220 A has also been found to be more stable in use.

The object of the present invention is to improve further on the garment disclosed in GB 2545220 A.

SUMMARY OF THE INVENTION

According to the invention, there is provided a durable lower body garment formed of a plurality of fabric panels and having an inner surface for facing towards the wearer and an outer surface for facing away from the wearer, the plurality of fabric panels defining a waist opening and a pair of leg openings,

- wherein the garment comprises a front fabric panel and at least one further fabric panel, the front fabric panel and the at least one further fabric panel being joined along their lateral edges to define the waist opening including a waist edge, each of the front fabric panel and the at least one further fabric panel extending from the waist edge to at least a crotch region of the garment, and wherein each of the front fabric panel and the at least one further fabric panel is formed of an elastically stretchable fabric,
- wherein the front fabric panel defines from 10% to 60% of a length of the waist edge and the at least one further fabric panel defines from 40% to 90% of the length of the waist edge, as measured when the garment is in its unworn state,
- wherein the front fabric panel is folded along the waist edge to define a front waist hem at the inner surface of the garment and the at least one further fabric panel is folded along the waist edge to define a further waist hem at the inner surface of the garment, the front waist hem and the further waist hem each having a depth of at least 15 mm,
- wherein the front waist hem and the further waist hem are ungathered when the garment is in the unworn state,
- and wherein an elongation under a load of 3.6 kg exhibited by the front waist hem, in a direction about the waist opening, is at least 10% greater than an elongation under a load of 3.6 kg exhibited by the further waist hem, in a direction about the waist opening.

The inventors have discovered that while known garments having a separate, non-continuous elastic waistband may provide improved comfort in general, a specific and unforeseen problem arises in that the joins between the elastic waistband and the fabric panels can cause elevated or excessive pressure and/or irritation. This problem is especially pronounced for wearers engaged in high intensity or endurance sports, for example.

The invention alleviates this problem by eliminating the separate waistband in favour of a waistband that is integrated into the fabric panels making up the garment. The integrated waistband of the invention utilises the inherent elasticity of the fabric panels, and thereby avoids the need for any gathering of the fabric panels and/or the waistband (in the unworn state). Differential properties are however provided in the front and rear portions of the waistband by configuring the waistband to be less extensible in the rear of the garment than in the front of the garment (as expressed in terms of elongation under a load of 3.6 kg). These differential properties may be achieved by restricting extensibility of the rear portion of the waistband, and have been found to provide many of the benefits of the garment that is disclosed in GB 2545220 A.

In particular embodiments, the elongation under a load of 3.6 kg exhibited by the front waist hem, in a direction about the waist opening, is from 20% to 200%, optionally from 50% to 150%, or from 60% to 120%, greater than an elongation under a load of 3.6 kg exhibited by the further waist hem, in a direction about the waist opening. Such elongation ranges have been found to provide enhanced comfort in the abdominal region by ensuring that the force which is carried through the waistband is distributed more across the enlarged area of the front fabric panel and less through the relatively narrow waistband area. This has been found to reduces the stress on the wearer's abdomen.

The invention may also provide a garment in which the force at 40% elongation (also referred to herein as the "modulus") exhibited by the further waist hem is at least 10% greater, optionally at least 20% greater, than the corresponding force exhibited by the front waist hem, both measured in a direction about the wait opening. This too has been found to provide a garment in which the stress on the wearer's abdomen is reduced, and may in an alternative aspect of the invention be taken to characterise the invention instead of the elongation relationship.

The front fabric panel defines a significant proportion of the waist edge. In certain embodiments, the front fabric panel defines from 20% to 50%, optionally from 25% to 40%, of a length of the waist edge and the at least one further fabric panel defines from 50% to 80% of the length of the waist edge, optionally from 60% to 75%, as measured when the garment is in its unworn state. The front fabric panel and the at least one further fabric panel account for the entirety of the waist edge. Such a configuration has been found to provide optimal comfort, although it should be noted that improvements in comfort may still be obtained with other configurations.

In embodiments, a depth of the front waist hem and/or the further waist hem may be from 40 mm to 90 mm, optionally from 50 mm to 80 mm, as measured when the garment is in its unworn state. By providing a relatively wide waist hem, stresses on the wearer's abdomen and around their back can be further reduced.

The differential elastic properties of the front waist hem and the further waist hem may be effected by arranging a layer of thermoplastic material within the further waist hem and/or the front waist hem. The thermoplastic material may serve to bond a folded portion of the fabric panel to a main portion of the fabric panel, and in this way limits elongation of the waist hem when a load is applied, for example when the garment is worn around the waist.

The thermoplastic material may be a thermoplastic elastomer, optionally thermoplastic polyurethane. Such material is known in the art as "bonding" and may be applied as a sheet of material in solid form which is subsequently activated by the application of heat and/or pressure. In alternative embodiments, the thermoplastic elastomer may be applied in liquid (molten) form, either continuously or patterned, and then allowed to solidify by cooling.

The differential elastic properties according to the invention may be configured by providing the thermoplastic material only in the further waist hem, or by providing the thermoplastic material in both the front waist hem and the further waist hem but in a lesser amount per unit length of hem in the front waist hem. Other means of configuring the differential elastic properties will be immediately apparent to those skilled in the art, for example using different types or grades of thermoplastic material or applying the thermoplastic material over different areas and/or in different patterns. The thermoplastic material is applied in such a way that the hems of the resulting garment are not gathered in the unworn state.

Included within the scope of the invention are alternative ways of providing the differential elastic properties of the front waist hem and the further waist hem, for example by providing patterns of stitching or other reinforcements across the hems so as to restrict elongation.

In some embodiments, the waist edge is defined by three fabric panels, these being the front fabric panel and two further fabric panels consisting of a left side fabric panel and a right side fabric panel, wherein the front fabric panel is joined along its lateral edges to a respective lateral edge of the left side fabric panel and the right side fabric panel, and wherein other lateral edges of the left side fabric panel and the right side fabric panel are joined together, to thereby surround the wearer in use.

In other embodiments, the waist edge is defined by four fabric panels, these being the front fabric panel and three further fabric panels consisting of a back fabric panel, a left side fabric panel and a right side fabric panel, wherein the front fabric panel is joined along its lateral edges to a respective lateral edge of the left side fabric panel and the right side fabric panel, and wherein the back fabric panel is joined along its lateral edges to a respective lateral edge of the left side fabric panel and the right side fabric panel, to thereby surround the wearer in use.

In these ways, the panels form a structure which surrounds a wearer in use. The body coverage provided by the panels may vary depending on the cut of the garment.

Furthermore, in any of these embodiments, the garment may further comprise a crotch fabric panel, in which case end edges of the front fabric panel and the back fabric panel (where present) are joined to respective end edges of the crotch fabric panel. Where a crotch fabric panel is provided, its lateral edges typically define parts of the leg openings. In embodiments not having a separate crotch fabric panel, the end edges of the front fabric panel and the back fabric panel (where present) may be joined directly.

In embodiments, a width of the front and back fabric panels (where present) tapers down towards the crotch region of the garment to thereby provide a close-fitting garment. The garment, excluding any decorative elements such as printing, may be symmetrical about a longitudinal centreline, the longitudinal centreline dividing the garment into left and right side halves.

In any of the embodiments described above, the fabric panels may be formed of a woven or knitted fabric having bi-directional elasticity (i.e. stretchable in two orthogonal directions). Insofar as the panels define the outer surface of the garment, they are each formed of a single piece of fabric, by which it is meant that they are not formed of multiple pieces of fabric that are joined together. In a preferred embodiment, the panels are, in their entirety (i.e. including the folded portions that form the waist hems), formed of a single piece of fabric. In some embodiments, however, the folded portions that form the waist hems may be joined to the panels, for example by stitching along a line that extends just behind the waist edge.

The requirement for the panels to be formed of a single piece of fabric does not exclude the possibility that the panels may include lines of stitching, for example to improve the fit of the garment. By way of example, a portion of the front fabric panel forming the outer surface of the garment may be provided with a dart extending from its lower end edge towards its waist end edge.

The woven or knitted fabric may, for example, comprise or consist of 50% to 98% by weight polyester (or another synthetic fibre) and 2% to 50% by weight elastane (spandex). Such a fabric is especially suitable for a close-fitting garment having a variety of applications and having good softness and handle.

In a particular aspect of the invention, the garment comprises gripping elements formed on its wearer facing surface, in particular on the waist hem. It has been found that optimal comfort may be provided when these gripping elements are provided only on the further waist hem, i.e. when the front fabric panel does not have gripping elements formed on its wearer facing surface. It has been found that such an arrangement of gripping elements reduces peak pressures on the wearer's skin for wearers engaged in high intensity sports.

The gripping elements are typically formed of a silicone material that may be applied directly to the waist hem. There may be from three to seven discrete gripping elements which are spaced apart. In especially preferred embodiments there are three and only three discrete gripping elements.

Specific embodiments of the garment described above may take the form of an undergarment, optionally a pair of briefs, trunks or boxers; or a pair of shorts, optionally a pair of cycling shirts or swim shorts; or a pair of leggings, optionally full length leggings or crop leggings. It has been found that the garment is especially suitable for sportswear or medical applications.

According to a further aspect of the invention, there is provided a durable lower body garment formed of a plurality of fabric panels and having an inner surface for facing towards the wearer and an outer surface for facing away from the wearer, the plurality of fabric panels defining a waist opening and a pair of leg openings, wherein the garment comprises a front fabric panel and at least one further fabric panel, the front fabric panel and the at least one further fabric panel being joined along their lateral edges to define the waist opening including a waist edge, each of the front fabric panel and the at least one further fabric panel extending from the waist edge to at least a crotch region of the garment, and wherein each of the front fabric panel and the at least one further fabric panel is formed of an elastically stretchable fabric, wherein the front fabric panel defines from 10% to 60% of a length of the waist edge and the at least one further fabric panel defines from 40% to 90% of the length of the waist edge, as measured when the garment is in its unworn state, wherein the front fabric panel is folded along the waist edge to define a front waist hem at the inner surface of the garment and the at least one further fabric panel is folded along the waist edge to define a further waist hem at the inner surface of the garment, the front waist hem and the further waist hem each having a depth of at least 15 mm, wherein the front waist hem and the further waist hem are ungathered when the garment is in the unworn state, and wherein an elongation under a load of 3.6 kg exhibited by the further waist hem, in a direction about the waist opening, is at least 10% greater than an elongation under a load of 3.6 kg exhibited by the front waist hem, in a direction about the waist opening.

In this alternative aspect, the differential elastic properties are configured so that the waistband is more extensible in the rear of the garment than in the front of the garment (as expressed in terms of elongation under a load of 3.6 kg). Such a configuration has been found to have specific applications, for example as a medical garment where there is a need to avoid or at least minimise elongation of the front portion of the waistband, for example where a wound needs to be protected.

Any of the optional features described above in relation to the first aspect of the invention may also be applied to this alternative aspect.

Further features and advantages provided by the lower body garment of the invention will become apparent from the following detailed description of the invention.

BRIEF DESCRIPTION OF THE DRAWINGS

Specific embodiments of the invention will now be described with reference to the accompanying drawings, in which.

DETAILED DESCRIPTION

The invention provides a durable lower body garment. As used herein, the term "durable" refers to a garment capable of being laundered and/or reused, and is used to distinguish the garment from garments that are designed and constructed for single-use, i.e. disposable garments for infant, geriatric and specialized healthcare use. The term "sportswear" refers to garments adapted for use while the wearer is engaged in sports activities, in particular high intensity or endurance sports activities.

Figure 1:
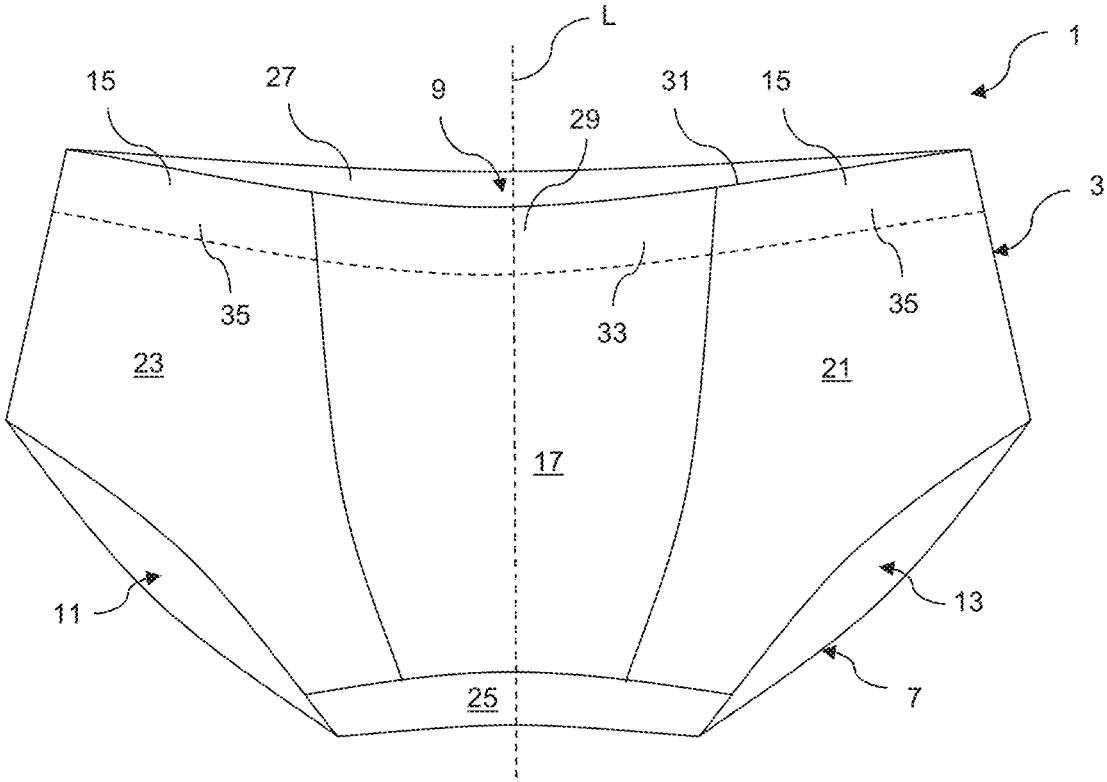
FIG. 1 is a front view of a lower body garment according to the invention.
Figure 2:
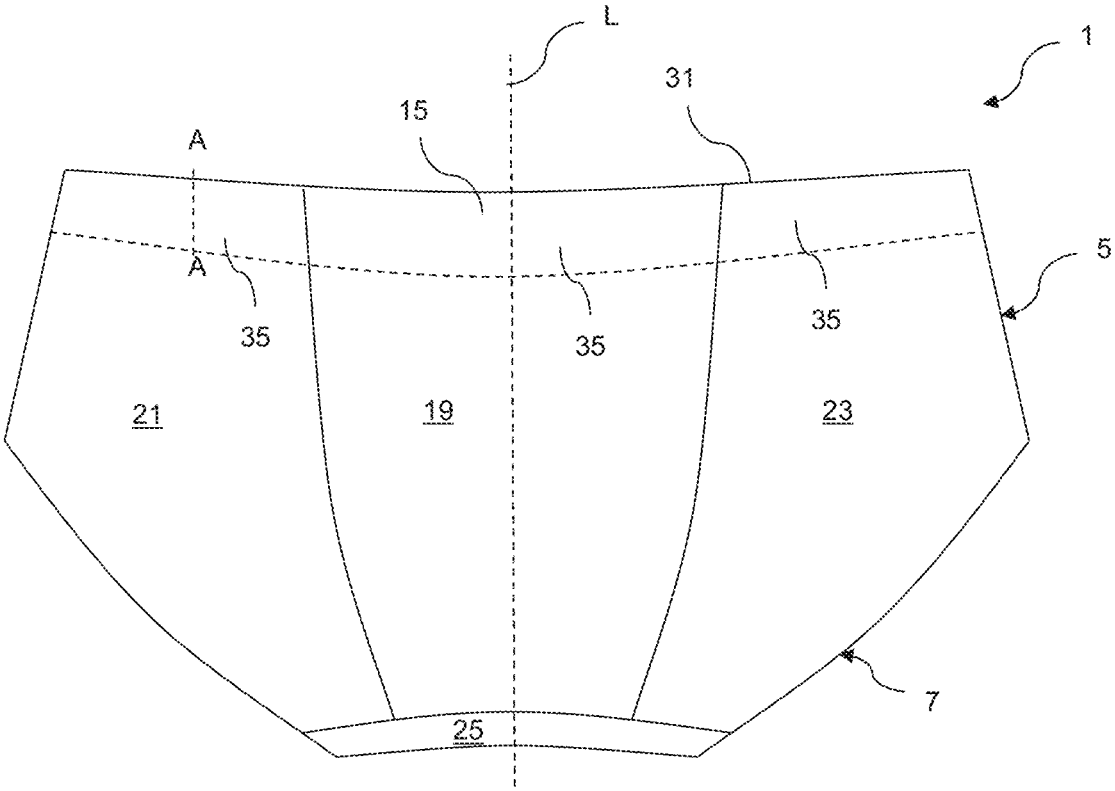
FIG. 2 is a back view of the lower body garment.

An embodiment of the durable lower body garment of the invention in the form of a pair of briefs 1 is shown in FIGS. 1 and 2. FIG. 1 is a front view of the briefs 1 and FIG. 2 is a back view of the briefs 1. The briefs 1, excluding any decorative elements such as labels and printing, are symmetrical about a longitudinal centreline L which divides the briefs 1 into left and right side halves.

The briefs 1 have a front region 3, a back region 5 and a crotch region 7 arranged in between the front region 3 and the back region 5. The crotch region 7 is narrower than the front and back regions 3, 5, and the front and back regions 3, 5, are connected to define a waist opening 9 and a pair of leg openings 11, 13. It should be noted that the connection between the front and back regions 3, 5 may or may not correspond to a physical joint. In the illustrated embodiment, a physical joint is not present, and the boundary between the regions is instead notional. Likewise, the boundary between the front and back regions 3, 5 and the crotch region 7 may correspond to a physical join or be notional.

The briefs 1 shown in FIGS. 1 and 2 are formed of a plurality of panels 17, 19, 21, 23, 25 each formed of an elastically stretchable fabric. By "elastically stretchable", it is meant that the fabric of the panels can be elongated by at least 50% when a force is applied and, when the force is removed, will recover essentially all of its elongation. Elastically stretchable fabrics of this type will be known to persons skilled in the art. The fabric of the panels is stretchable in in this way in two orthogonal directions, i.e. it has bi-directional elasticity.

The fabric panels include a front fabric panel 17; a plurality of further fabric panels in the form of a back fabric panel 19, a left side fabric panel 21 and a right side fabric panel 23; and also a crotch fabric panel 25. The briefs 1 in their assembled state have a wearer (skin) facing surface 27, which faces inwardly, and an outer garment facing surface 29, which faces outwardly.

In the illustrated embodiment, the fabric panels 17, 19, 21, 23, 25 are formed of a knitted fabric consisting of 90% by weight polyester and 10% by weight elastane (spandex). In alternative embodiments, the fabric panels may be formed of other types of knitted fabric, and even woven fabrics, as long as the fabric has suitable elastic properties. Each of the fabric panels is defined by a single piece of the knitted fabric.

The waist opening 9 of the briefs 1 defines a waist edge 31 which encircles the wearer when the briefs 1 are worn. The waist edge 31 is defined by the front fabric panel 17 and the further fabric panels 19, 21, 23. In particular, 70% of the total length of the waist edge 31 (in the unworn state) is defined by the further fabric panels 19, 21, 23 and 30% of the total length of the waist edge 31 (in the unworn state) is defined by the front fabric panel 17.

The front fabric panel 17 and the further fabric panels 19, 21, 23 extend from the waist edge 31 to the crotch region 7. Lateral edges of the front fabric panel 17 are joined to respective lateral edges of the left side fabric panel 21 and the right side fabric panel 23. The back fabric panel 19 is then joined along its lateral edges to respective lateral edges of the left side fabric panel 21 and the right side fabric panel 23. In this way, the panels form a structure which surrounds the wearer, in use.

A width of the front and back fabric panels 17, 19 tapers down towards the crotch region 7 of the briefs 1, so as to provide a close-fitting garment.

The crotch fabric panel 25 is centred on the crotch region 7 of the briefs 1. End edges of the front fabric panel 17 and the back fabric panel 19 are joined to respective end edges of the crotch fabric panel 25. Lateral edges of the crotch fabric panel 25 define parts of the leg openings 11, 13.

The joins between the adjacent fabric panels, and between the fabric panels and the elastic waistband 15, may be formed as flatlock seams. The leg openings 11, 13 may be hemmed.

According to the invention, the front fabric panel 17 is folded along the waist edge 31 to define a front waist hem 33 at the inner surface of the garment 1 and the further fabric panels in the form of the back fabric panel 19, the left side fabric panel 21 and the right side fabric panel 23 are folded along the waist edge to define a further waist hem 35 at the inner surface of the garment 1. The hems are not directly visible in FIGS. 1 and 2, but the end edges of the hems are indicated by dashed lines. The front waist hem 33 and the further waist hem 35 each have a depth 50 mm, although it should be noted that the depth of the hems 33, 35 may be different to this and different to each other.

The front waist hem 33 and the further waist hem 35 are configured to be ungathered when the garment 1 is in the unworn state, by which it is meant that they do not exhibit the typically ruffled appearance of a gathered elastic waistband.

Figure 3:
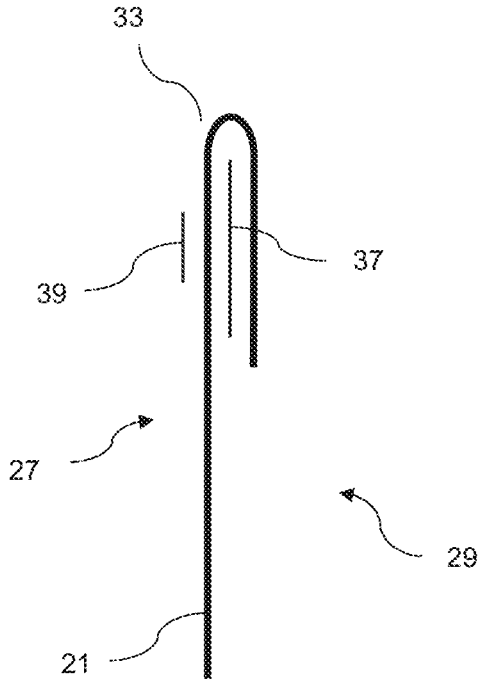
FIG. 3 is a schematic cross-sectional view of the lower body garment taken along line A-A in FIG. 2.

As illustrated in the partial cross-section of FIG. 3, the front waist hem 33 and the further waist hem 35 are provided with layer or strip of thermoplastic polyurethane 37, which is a thermoplastic elastomer that serves to bond the hems 33, 35 together and at the same time restrict the elastic elongation of the hems 33, 35 when a load is applied along the direction of the waist edge 31. The thermoplastic polyurethane 37, which is a hemming material that is known in the art, is applied as a pre-fabricated sheet during manufacture of the garment and is activated by heat and/or pressure once the hems 33, 35 have been formed. In this way, the garment 1 is provided with a waistband that has a higher elastic modulus (corresponding to a lower elongation under load) than the remainder of the fabric panels that make up the garment.

The amount of the thermoplastic polyurethane 37 per unit length of hem in the further waist hem 35 is greater than the amount of the thermoplastic polyurethane 37 per unit length of hem the front waist hem 33. In this way, the rear part of the waistband defined by the further waist hem 35 has a higher elastic modulus (or lower elongation under load) than the front part of the waistband defined by the front waist hem 33.

In particular, the front waist hem 33 of the specific embodiment exhibits an elongation under a load of 3.6 kg, in a direction about the waist opening, of approximately 60%. The further waist hem 35 exhibits an elongation under a load of 3.6 kg, in a direction about the waist opening, of approximately 40%. The measured elongation is therefore 50% greater in the front waist hem 33 than it is in the further waist hem (60%/40%). Such an elongation relationship has been found to provide enhanced comfort in the abdominal region by ensuring that the force which is carried through the waistband is distributed more through the enlarged area of the front fabric panel and less through the relatively narrow front waistband area. This has been found to reduces the stress on the wearer's abdomen.

The differential elastic properties can also be expressed in terms of the force at 40% elongation (also referred to herein as the "modulus") exhibited by the waist hems. In particular the force at 40% elongation should be at least 20% greater in the further waist hem 35 than in the front waist hem 33 to provide optimal abdominal comfort.

The waistband region of the briefs 1 shown in FIGS. 1 to 3 also comprises three discrete gripping elements 39 formed on the wearer facing surface 27 (these are hidden from view in FIGS. 1 and 2 but a single one of the gripping elements 35 can be seen in the cross-sectional view of FIG. 3). The gripping elements 35 are formed of a silicone material applied directly to the further waist hem 35. The gripping elements are arranged on the elastic waistband 15 only in the areas of the wearer's hips and back. No gripping elements are provided on the front waist hem 33. It has been found by experimentation that optimal comfort (i.e. measured as reduced dynamic pressure peaks during sports exercise) is provided with such a configuration. Such a configuration also reduces friction and therefore discomfort particularly in the lower abdominal region.

A specific embodiment of the inventive garment of the invention has been described in detail. Various changes may be made to the specific embodiment without departing from the invention, which is defined solely by the claims. Such changes will be apparent to the skilled person.

As used herein, values for elongation under a load of 3.6 kg and for force at 40% elongation, given in relation to the front waist hem and the further waist hem, are to be measured using a modified version of BS EN ISO 20932-3:2020 (Textiles—Determination of the elasticity of fabrics).

In particular, elongate test specimens are to be obtained by carefully cutting the front waist hem and the further waist hem from the garment using shears. A fixed width of the waist regions is removed, which width corresponds to the maximum depth of the front and further waist hems. In this way, the test specimen comprising the entire front waist hem and the test specimen comprising the entire further waist hem have the same width, so that measurement results are comparable, even where the hems have a different depth. The specimen length corresponds to the entire length of the front waist panel along the waist edge (for the front waist hem) and the entire combined length of the further waist panels along the waist edge (for the further waist hem). The test specimens will in general have different lengths, but the elongation is calculated in percentage terms.

The test specimens are tested using "Method A" of BS EN ISO 20932-3:2020, with a specified force of 3.6 kg and five cycles, with measurements being taken on the fifth cycle. The test specimens are clamped in the jaws of the testing machine so that the gauge length is 50 mm smaller than the specimen length, with 25 mm of the specimen length being arranged in the jaws at each end.

The elongation under a load of 3.6 kg for a component is expressed in terms of a percentage (extension of the test specimen as a percentage of its initial length). According to the invention, an elongation under a load of 3.6 kg exhibited by the front waist hem, in a direction about the waist opening, is at least 10% (or some other figure) greater than an elongation under a load of 3.6 kg exhibited by the further waist hem, in a direction about the waist opening. For the avoidance of doubt, this 10% figure (and corresponding other figures), refers to a relative measurement (elongation of the front waist hem as a percentage of elongation of the further waist hem). It does not refer to an absolute measurement, even though the underlying elongation under a load of 3.6 kg is also expressed in terms of a percentage.

The invention claimed is:

1. A durable lower body garment formed of a plurality of fabric panels and having an inner surface for facing towards the wearer and an outer surface for facing away from the wearer, the plurality of fabric panels defining a waist opening and a pair of leg openings, wherein the garment comprises a front fabric panel and at least one further fabric panel, the front fabric panel and the at least one further fabric panel being joined along their lateral edges to define the waist opening including a waist edge, each of the front fabric panel and the at least one further fabric panel extending from the waist edge to at least a crotch region of the garment, and wherein each of the front fabric panel and the at least one further fabric panel is formed of an elastically stretchable fabric, wherein the front fabric panel defines from 10% to 60% of a length of the waist edge and the at least one further fabric panel defines from 40% to 90% of the length of the waist edge, as measured when the garment is in its unworn state, wherein the front fabric panel is folded along the waist edge to define a front waist hem at the inner surface of the garment and the at least one further fabric panel is folded along the waist edge to define a further waist hem at the inner surface of the garment, the front waist hem and the further waist hem each having a depth of at least 15 mm, wherein the front waist hem and the further waist hem are ungathered when the garment is in the unworn state, wherein the further waist hem comprises a layer of thermoplastic material for bonding a folded portion of the at least one further fabric panel to a main portion of the at least one further fabric panel, the layer of thermoplastic material serving to limit elongation of the further waist hem under load, such that an elongation under a load of 3.6 kg exhibited by the front waist hem, in a direction about the waist opening, is at least 10% greater than an elongation under a load of 3.6 kg exhibited by the further waist hem, in a direction about the waist opening.

2. The durable lower body garment of claim 1, wherein an elongation under a load of 3.6 kg exhibited by the front waist hem, in a direction about the waist opening, is from 20% to 200% greater than an elongation under a load of 3.6 kg exhibited by the further waist hem, in a direction about the waist opening.

3. The durable lower body garment of claim 1, wherein the front fabric panel defines from 20% to 50% of a length of the waist edge and the at least one further fabric panel defines from 50% to 80% of the length of the waist edge, as measured when the garment is in its unworn state.

4. The durable lower body garment of claim 1, wherein the front fabric panel and the at least one further fabric panel together define 100% of a length of the waist edge.

5. The durable lower body garment of claim 1, wherein a depth of the front waist hem and/or the further waist hem is from 40 mm to 90 mm, as measured when the garment is in its unworn state.

6. The durable garment of claim 1, wherein the thermoplastic material is a thermoplastic elastomer.

7. The durable lower body garment of claim 1, wherein the thermoplastic material is not present within the front waist hem, or wherein the thermoplastic material is present within the front waist hem but in a lesser amount per unit length of hem than the amount per unit length of hem arranged within the further waist hem.

8. The durable lower body garment of previously presented claim 1, wherein the further waist hem is deeper than the front waist hem, as measured when the garment is in its unworn state.

9. The durable lower body garment of claim 1, wherein the waist edge is defined by four fabric panels, these being the front fabric panel and three further fabric panels consisting of a back fabric panel, a left side fabric panel and a right side fabric panel, wherein the front fabric panel is joined along its lateral edges to a respective lateral edge of the left side fabric panel and the right side fabric panel, and wherein the back fabric panel is joined along its lateral edges to a respective lateral edge of the left side fabric panel and the right side fabric panel, to thereby surround the wearer in use.

10. The durable lower body garment of claim 9, further comprising a crotch fabric panel, wherein end edges of the front fabric panel and the back fabric panel are joined to respective end edges of the crotch fabric panel.

11. The durable lower body garment of claim 10, wherein lateral edges of the crotch fabric panel are not joined to any other fabric panel and instead define edges of the leg openings.

12. The durable lower body garment of claim 1, wherein a width of the front fabric panel tapers down from the waist edge towards the crotch region of the garment.

13. The durable lower body garment of claim 1, wherein the front fabric panel and the at least one further fabric panel are formed of a woven or knitted fabric.

14. The durable lower body garment of claim 13, wherein a portion of the front fabric panel that forms the outer surface of the garment is a single piece of fabric, and wherein a portion of each further fabric panel that forms the outer surface of the garment is a single piece of fabric.

15. The durable lower body garment of claim 13, wherein the woven or knitted fabric panels consist of 50% to 98% by weight polyester and 2% to 50% by weight elastane/spandex.

16. The durable lower body garment of claim 1, further comprising a plurality of gripping elements formed on the further waist hem defining the inner surface of the garment.

17. The durable lower body garment of claim 16, wherein the gripping elements are formed of a silicone material applied directly to the further waist hem.

18. The durable lower body garment of claim 16, wherein three and only three gripping elements are formed on the further waist hem defining the inner surface of the garment.

19. The durable lower body garment of claim 1, wherein the garment, excluding any decorative elements such as printing, is symmetrical about a longitudinal centreline, the longitudinal centreline dividing the garment into left and right side halves.

20. The durable lower body garment of claim 1, wherein the garment is an undergarment.

21. The durable lower body garment of claim 1, wherein the garment is a pair of shorts.

22. A sportswear garment or a medical garment comprising the durable lower body garment of claim 1.

* * * * *